United States Patent [19]

Blümle

[11] Patent Number: 4,601,388

[45] Date of Patent: Jul. 22, 1986

[54] APPARATUS FOR ALIGNING FLAT ARTICLES

[75] Inventor: Martin Blümle, Horhausen, Fed. Rep. of Germany

[73] Assignee: Winkler & Dunnebier Maschinenfabrik und Eisengiesserei GmbH & Co. KG, Neuwied, Fed. Rep. of Germany

[21] Appl. No.: 695,375

[22] Filed: Jan. 28, 1985

[30] Foreign Application Priority Data

Feb. 4, 1984 [DE] Fed. Rep. of Germany ..... 3403909

[51] Int. Cl.[4] ..... B65G 19/02

[52] U.S. Cl. ..... 198/726

[58] Field of Search ..... 198/726, 779, 732, 733, 198/735, 644, 627, 734; 271/275, 271, 198, 233

[56] References Cited

U.S. PATENT DOCUMENTS

| | | | |
|---|---|---|---|
| 898,250 | 9/1908 | Mitchell | 198/726 X |
| 2,669,342 | 2/1954 | Neal | 198/726 X |
| 2,727,345 | 12/1955 | Schoppee | 198/726 X |
| 2,857,158 | 10/1958 | Ungerer | 271/240 |
| 3,557,933 | 1/1971 | Sopher | 198/733 |
| 3,971,467 | 7/1976 | Anderson | 198/726 |
| 4,198,901 | 4/1980 | Knudsen | 198/726 X |
| 4,240,540 | 12/1980 | Hobbs et al. | 198/726 X |

*Primary Examiner*—Joseph E. Valenza
*Assistant Examiner*—D. Glenn Dayoan
*Attorney, Agent, or Firm*—Collard, Roe & Galgano

[57] ABSTRACT

There is provided an apparatus for aligning flat articles such as envelopes, flat bags or the blanks therefor or the like. According to the main feature of the apparatus, an article-supporting slideway is provided and lateral toothed belts run around reversing sprockets and are provided with article-engaging entraining members, the rotational axes of the reversing sprockets being perpendicular to the plane of the slideway.

4 Claims, 3 Drawing Figures

APPARATUS FOR ALIGNING FLAT ARTICLES

The present invention relates to an apparatus for aligning flat articles such as envelopes, flat bags or the blanks therefor or the like.

Apparatus of the kind referred to are known, for instance, in the form of so-called four-finger adjusting stations. The adjusting or controlling fingers perform oscillating motions. The result at high speeds of operation is uneven running, so that if a satisfactory result is desired apparatus of this kind must be operated at low speeds. Another disadvantage of this type of apparatus is that the blanks stop on their passage through the apparatus and therefor need to be accelerated again.

Also known are apparatus having chains whose reversing sprockets rotate around horizontal axes. The wear in apparatus of this kind is fairly heavy. Also, the articles it is required to align are very exposed to soiling by drops of lubricant. Furthermore, the motion of the entraining cams or abutments or the like is not smooth and withdrawing segments of very extreme shapes is necessary since the entraining cams, as they move away downwards, accelerate the articles considerably and may jam in unfavorable places or tear the articles. A conical aligning movement is possible only to a limited extent by making the chains converge conically in their movement with the unfortunate result of increased wear of the costly chain-guiding elements. Another disadvantage of this type of apparatus is that it is fairly noisy.

It is, therefore, a primary object of the present invention, using relatively simply means, to align flat articles such as blanks for envelopes or flat bags or the like, for instance, before the printing station.

This object is accomplished according to the present invention by the provision of an article-supporting slideway and lateral toothed belts which run around reversing sprockets and which have article-engaging entraining members, the rotational axes of the reversing sprockets being perpendicular to the plane of the slideway.

Preferably, the entraining members are pins associated with support rolls which run on lateral guides. The free ends of the pins extend through a slot in the slideway and engage the article, for instance, near the corner between the slide flap and closure flap of an envelope or flat bag. The pins are guided by means of the support rolls on lateral guides so that the motion is very smooth and their direction controllable. There is no risk of the blanks being soiled by lubricant since the toothed belts and their entraining members never rotate immediately below parts which require lubricating. Also, the articles being aligned continue to move at the same speed without deceleration or acceleration when they pass into the next station, since the entraining members on the toothed belts depart gradually and with a reduction of their speed in the conveying direction from the path of the articles at the reversal station.

Other objects and features of the present invention will become apparent from the following detailed description considered in connection with the accompanying drawing. It is to be understood, however, that the drawing is designed as an illustration only and not as a definition of the limits of the invention.

In the drawing wherein similar reference characters denote similar elements throughout the several views.

Figure 1:
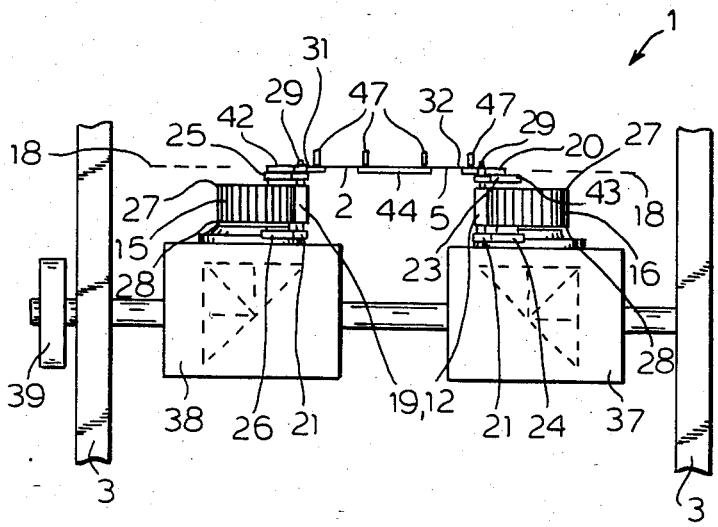
FIG. 1 is a schematic illustration of an end view of the apparatus of the present invention.
Figure 2:
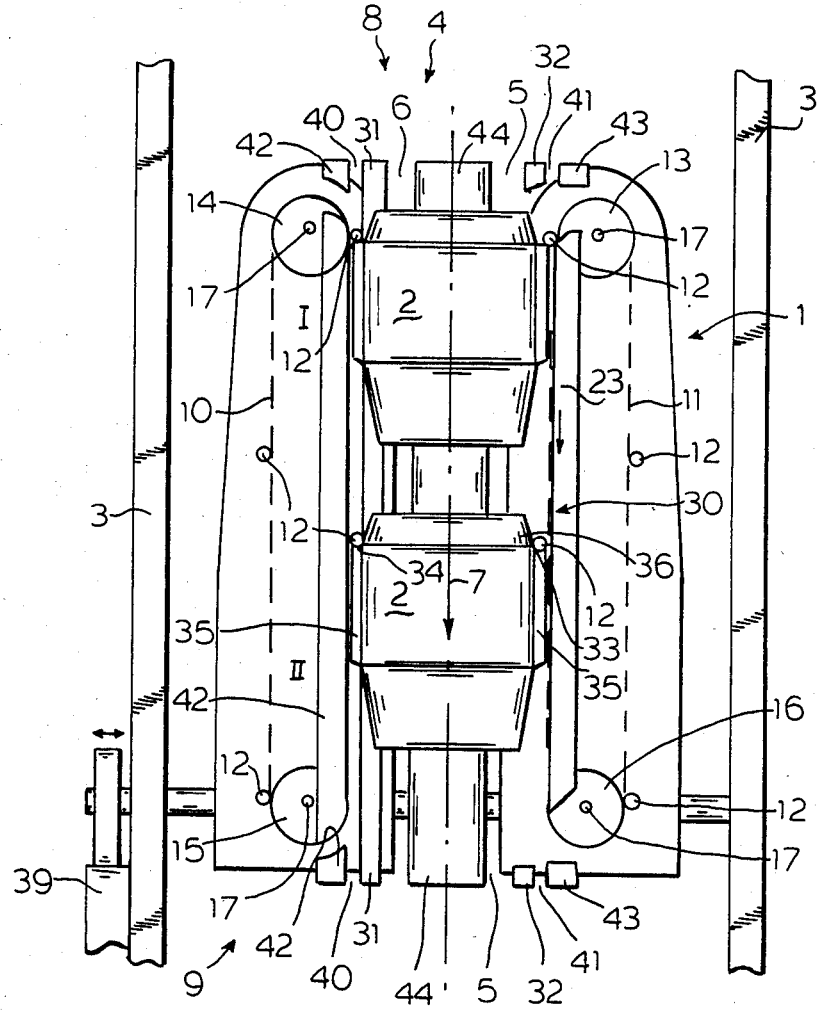
FIG. 2 is a plan view of the apparatus of FIG. 1 with the slideway plates interrupted.

Now turning to the drawing, there is shown in FIGS. 1 and 2 an apparatus, generally designated 1, for aligning flat articles 2 such as envelopes or flat bags or blanks therefor comprising a machine frame 3 having a slideway 4 formed with slots 5, 6 and 40, 41. Flat articles 2 are displaced from one another on the slideway 4 a short distance and are conveyed from one end 8 of apparatus 1 to its other end 9 in the direction indicated by arrow 7. Articles 2 are conveyed and simultaneously aligned by means of toothed belts 10 and 11 which are provided with entraining members 12 for engaging the articles. Belts 10 and 11 are disposed in spaced-apart parallel relationship to one another on either side of and on the outside of articles 2 and run around reversing sprockets 13 to 16 whose axes 17 are perpendicular to plane 18 of slideway 4.

Belts 10 and 11, their mounting and their drive mechanism are disposed below slideway plane 18. Only entraining members 12 or parts thereof extend upwards through slots 40 and 41 and, as they rotate around sprockets 13 to 16, engage with and entrain articles 2. Slots 5, 6 and 40, 41 are parallel to one another.

Entraining members 12 are comprised of pins 19 which are secured to belts 10 and 11 and which carry support rolls 20 and 21. When members 12 move in the direction indicated by arrow 7, i.e., in their operative direction for aligning articles 2, rolls 20 and 21 of members 12 supported respectively by belts 11 and 10 run on lateral guides 23, 24 and 25, 26, respectively. The same are, for instance, flat sections and are disposed in planes parallel to the sprocket end faces.

Figure 3:
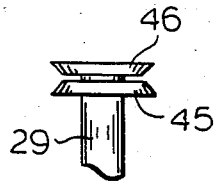
FIG. 3 is an enlarged side view of the end parts of an entraining member.

In practical operation, pins 19 are disposed preferably vertically and extend above and below belts 10 and 11 and support rolls 20 and 21 extend above and below, respectively, the side edges 27 and 28 of belts 10 and 11. Correspondingly, guides 23, 25 and 24, 26 are disposed above and below, respectively, belt edges 27 and 28. Only a short free end part 29 of pin 19 projects above top support roll 20 and acts directly as an entraining cam or finger or the like for the article 2 it is required to align. In the normal case the pin-like free end part 29 extends out completely as an entraining cam or finger or the like; however, if required and more particularly when thin paper is being processed, each end member 29, as clearly seen in FIG. 3, can carry a bottom dished member 45 and a top dished member 46 to prevent bulging-out of the corners 33 and 34 respectively of articles 2.

The entraining members 12, i.e., end parts 29, of each belt 10 and 11 move along an aligning section 30 between inner plates 31 and 32 and outer plates 42 and 43 of slideway 4.

Lateral guides 23, 24 and 25, 26 so guide members 12 by way of rolls 20 and 21 that members 12 converge towards one another funnel-fashion over a first portion I of their path and align articles 2 laterally and in the conveying direction, then run parallel to one another along a second portion II of their path, aligning articles 2 accurately and transferring them smoothly to the next station.

Also, slideway 4, belts 10 and 11 and guides 23 to 26 are so arranged that pin 19 engages, by way of its free end part 29 or the members 45 and 46, the article or blank 2 for an envelope near the corners 33 and 34, respectively, between a slide flap 35 and a closure flap 36. The left-hand half and the right-hand half of the aligning facility are adjustable laterally as a unit in dependence upon format. To this end, plates 31 and 42 which are secured to one half of the aligning facility and define slot 40, and the plates 32 and 43 which are secured to the other half of the aligning facility and define slot 41, are simultaneously moved laterally. The width of slots 5 and 6 is therefore altered by such movement. Central plate 44 remains stationary.

Slideway 4 therefore comprises adjustable plates 31, 42 and 32, 43 and non-adjustable plate 44. The width of slots 40 and 41 is fixed but the width of slots 5 and 6 is variable. As can be gathered more particularly from FIG. 1, further guide elements in the form of top guides 47 are disposed above slideway 4.

Sprockets 13 to 16 are driven by way of angle drives 37 and 38 and helical transmission gearing 39. These drives and transmissions are mounted in frame 3 in a known manner.

While only a single embodiment of the present invention has been shown and described, it will be obvious that many changes and modifications may be made thereunto without departing from the spirit and scope of the invention.

What is claimed is:

1. An apparatus for aligning flat articles such as envelopes, flat bags or the banks therefor or the like, said apparatus comprising:

(a) an article-supporting slideway having longitudinal slots formed therein;

(b) laterally arranged toothed belts disposed on either side of said slideway, said belts being guided around reversing sprockets having rotational axes perpendicular to said slideway;

(c) article-engaging entraining members supported by said belts, said entraining members including support rolls and a pin whose free end extends through said slots of said slideway to engage said articles; and (d) lateral guides for said entraining members on which said support rolls of said entraining members run and are guided, said guides being arranged to guide said entraining members supported by the respective laterally arranged belts to coverage towards one another funnel-fashion over a first portion of their path and to move parallel to one another over a second portion of their path, wherein each lateral guide includes a guide disposed above and below the edges of the associated lateral toothed belt, and the pin of each entraining member is supported by an upper roll and a lower roll which are correspondingly guided by the upper and lower guides of the respective lateral guide, said toothed belt and sprockets, said lateral guides, said support rolls and a major portion of each of said pins of said entraining members being disposed below said slideway, said toothed belts and said lateral guides being so disposed that in the case of an envelope blank the free end of the pin of the entraining members extending through the slots of said slideway engage at the corner between the side flap and the closure flap of the envelope blank.

2. The apparatus according to claim 1, wherein the pin of said entraining member is provided with an end part comprising a bottom dished member and a top dished member.

3. The appartaus as defined in claim 1, wherein each of the laterally arranged toothed belts and lateral guides are laterally adjustable so as to accommodate the format of the flat articles to be aligned.

4. The apparatus as defined in claim 1, wherein the reversing sprockets for guiding said toothed belts are driven by angle drives.

* * * * *